US006343910B1

(12) United States Patent
Kawasaki et al.

(10) Patent No.: US 6,343,910 B1
(45) Date of Patent: Feb. 5, 2002

(54) TURBO-MOLECULAR PUMP

(75) Inventors: Hiroyuki Kawasaki; Hiroshi Sobukawa, both of Tokyo (JP)

(73) Assignee: Ebera Corporation, Tokyo (JP)

( * ) Notice: Subject to any disclaimer, the term of this patent is extended or adjusted under 35 U.S.C. 154(b) by 0 days.

(21) Appl. No.: 09/531,894

(22) Filed: Mar. 21, 2000

(30) Foreign Application Priority Data

Mar. 23, 1999 (JP) ..... 11-078048

(51) Int. Cl.[7] ..... F01D 1/36
(52) U.S. Cl. ..... 415/90; 415/177; 415/199.5
(58) Field of Search ..... 415/90, 72, 73, 415/74, 143, 199.4, 199.5; 416/176, 177

(56) References Cited

U.S. PATENT DOCUMENTS 4,668,160 A * 5/1987 Mase et al. ..... 415/90
4,797,062 A * 1/1989 Deters et al. ..... 415/90
6,030,189 A * 2/2000 Bohm et al. ..... 417/423.4
6,168,374 B1 * 1/2001 Stolle et al. ..... 415/90

FOREIGN PATENT DOCUMENTS

JP 63-230990 9/1988
JP 407004383 A * 1/1995

* cited by examiner

*Primary Examiner*—Edward K. Look
*Assistant Examiner*—James M McAleenan
(74) *Attorney, Agent, or Firm*—Armstrong, Westerman, Hattori, McLeland & Naughton, LLP

(57) ABSTRACT

A turbo-molecular pump has a casing, a stator fixedly mounted in the casing, and a rotor supported in the casing for rotation relatively to the stator. A turbine blade pumping assembly and a thread groove pumping assembly for discharging gas molecules are disposed between the stator and the rotor. The rotor comprises at least two components constituting the turbine blade pumping assembly and the thread groove pumping assembly. The components are separable from each other at a predetermined position, and joined to each other to form the rotor.

9 Claims, 11 Drawing Sheets

TURBO-MOLECULAR PUMP

BACKGROUND OF THE INVENTION

1. Field of the Invention

The present invention relates to a turbo-molecular pump for evacuating gas in a chamber used in a semiconductor fabrication process or the like, and more particularly to a turbo-molecular pump which is compact and has a high evacuating capability.

2. Description of the Related Art

Processes of fabricating high-performance semiconductor devices employ a turbo-molecular pump for developing high vacuum or ultrahigh vacuum. The turbo-molecular pump comprises a rotor rotatably supported in a cylindrical casing and having a plurality of rotor blades, the cylindrical casing having a plurality of stator blades projecting from an inner surface thereof between the rotor blades. The interdigitating rotor and stator blades make up a turbine blade pumping assembly. When the rotor is rotated at a high speed, gas molecules move from an inlet of the cylindrical casing to an outlet thereof to develop a high vacuum in a space that is connected to the inlet.

In order to achieve a high vacuum, it is necessary for the pump to provide a large compression ratio for the gas. Conventional efforts to meet such a requirement include providing the rotor and stator blades in a multistage manner or incorporating a thread groove pumping assembly downstream of the turbine blade pumping assembly. The rotor and a main shaft supporting the rotor are supported by magnetic bearings for easy maintenance and high cleanliness.

Recently, semiconductor fabrication apparatuses tend to use a larger amount of gas as wafers are larger in diameter. Therefore, a turbo-molecular pump used to evacuate gas in a chamber in such a semiconductor fabrication apparatus is required to evacuate gas in the chamber at a high rate, keep the chamber under a predetermined pressure or less, and have a high compression capability.

However, the turbo-molecular pump capable of evacuating gas in the chamber at a high rate and having a high compression capability has a large number of stages, a large axial length, and a large weight, and is expensive to manufacture. In addition, the turbo-molecular pump takes up a large space around the chamber in a clean room. Such space needs a large construction cost and maintenance cost. Another problem is that when the rotor is broken under abnormal conditions, the turbo-molecular pump produces a large destructive torque, and hence cannot satisfy desired safety requirements.

SUMMARY OF THE INVENTION

It is therefore an object of the present invention to provide a turbo-molecular pump which is axially compact and has a sufficient evacuation and compression capability.

In order to achieve the above object, according to the present invention, there is provided a turbo-molecular pump comprising: a casing; a stator fixedly mounted in the casing; a rotor supported in the casing and being rotatable at a high speed; and a turbine blade pumping assembly and a thread groove pumping assembly which are disposed between the stator and the rotor; the rotor being formed by joining at least two components which are separable from each other at a predetermined position. The rotor comprises at least two components that are axially separate from each other.

The components of the rotor can individually be manufactured by machining, for example. The rotor can easily be manufactured under less strict machining limitations so as to have a shape suitable for a high evacuation and compression capability. Therefore, the turbo-molecular pump can evacuate gas at a high rate and has high compression capability.

The thread groove pumping assembly may comprise at least one of a spiral thread groove pumping assembly for discharging gas molecules radially and a cylindrical thread groove pumping assembly for discharging gas molecules axially. A plurality of cylindrical thread groove pumping assemblies may be radially superposed to provide a passage of increased length for discharging gas molecules.

The components of the rotor can be joined by shrink fitting or bolts. If the components of the rotor have interfitting recess and projection, then the components can easily be positioned with respect to each other and firmly be fixed to each other. The position where the components of the rotor are separable from each other is determined in consideration of simplicity for manufacturing the rotor and the mechanical strength of the rotor. For example, the components of the rotor may be separate from each other between the turbine blade pumping assembly, and the spiral thread groove pumping assembly or the cylindrical thread groove pumping assembly.

The spiral thread groove pumping assembly is usually disposed downstream of the turbine blade pumping assembly, and has evacuating passages for discharging gas molecules in a radial direction. Therefore, the spiral thread groove pumping assembly has an increased evacuation and compression capability with out involving an increase in the axial dimension thereof. Although the rotor with the spiral thread groove pumping assembly is complex in shape, the rotor can be manufactured with relative ease because it is composed of at least two components which are separable from each other.

The cylindrical thread groove pumping assembly is usually disposed downstream of the turbine blade pumping assembly, and provides a cylindrical space between the rotor and the stator. The cylindrical thread groove pumping assembly may be arranged to provide two or more radially superposed passages for discharging gas molecules. The cylindrical thread groove pumping assembly having the above structure provides a long passage for discharging gas molecules, and has an increased evacuation and compression capability without involving an increase in the axial dimension thereof. Although the rotor with the cylindrical thread groove pumping assembly is complex in shape, the rotor can be manufactured with relative ease because it is composed of at least two components which are separable from each other.

The components of the rotor may be made of one material or different materials. Blades of the stator and rotor may be made of an aluminum alloy. However, when the turbo-molecular pump operates under a higher back pressure than the conventional one, the components made of the aluminum alloy tend to suffer strains caused by forces or pressures applied to the rotor or creep caused by increase of temperature, resulting in adverse effects on the stability and service life of the pump. In addition, the rotor may rotate unstably because the components of the aluminum alloy are liable to be expanded at higher temperatures. According to the present invention, some or all of the components of the rotor may be made of a titanium alloy which has a high mechanical strength at high temperatures or ceramics which have a high specific strength and a small coefficient of thermal expansion. The components made of the titanium alloy or ceramics are prevented from being unduly deformed or thermally expanded to reduce adverse effects on the service life of the pump and to operate the pump stably. These materials are also advantageous in that they are highly resistant to corrosion. Furthermore, because the rotor is composed of at least two components, the rotor may be made of one or more of different materials depending on the functional or manufacturing requirements for the pump.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

Figure 1:
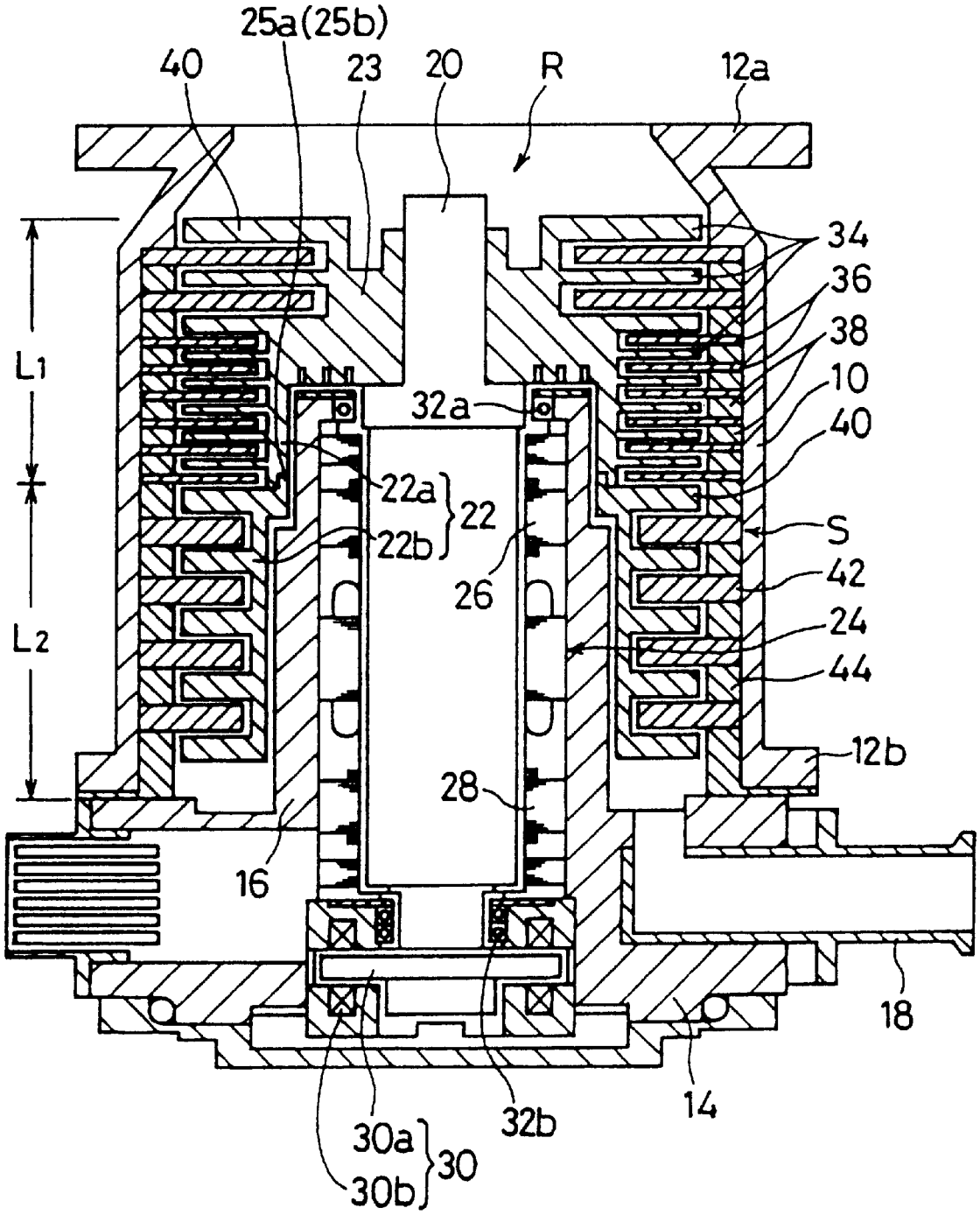
FIG. 1 is an axial cross-sectional view of a turbo-molecular pump according to a first embodiment of the present invention.

Like or corresponding parts are denoted by like or corresponding reference numerals throughout views.

Figure 2A:
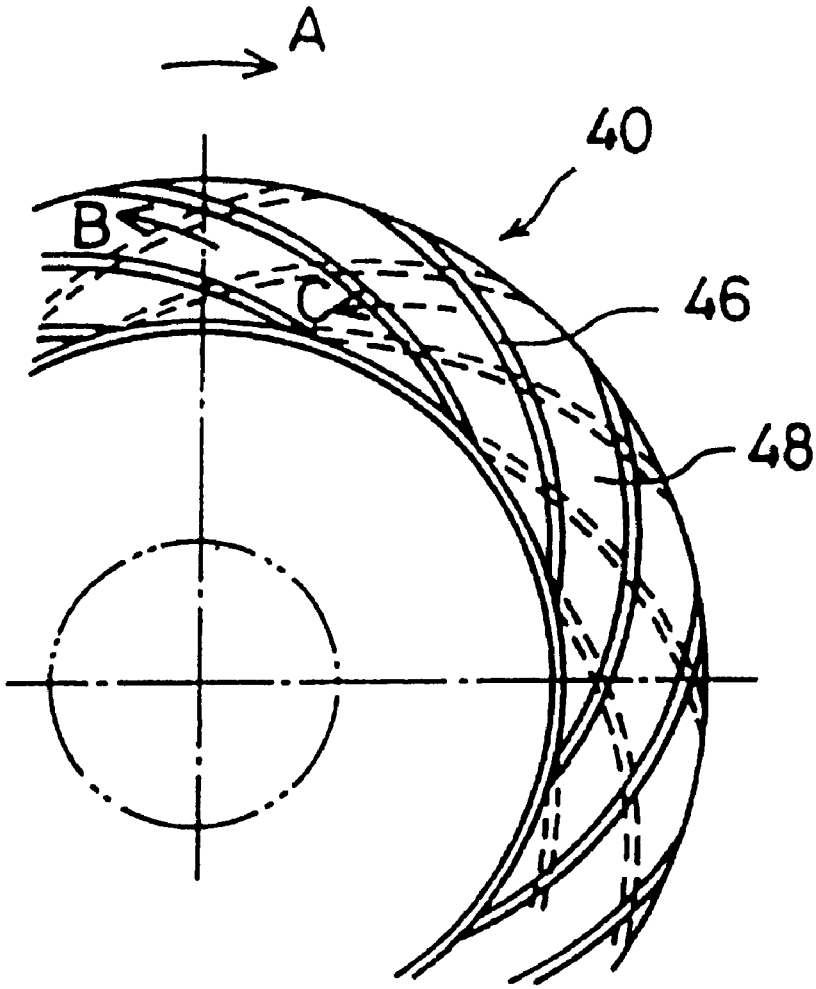
FIG. 2A is a plan view of a rotor blade of a thread groove pumping assembly in the turbo-molecular pump shown in FIG. 1.
Figure 2B:
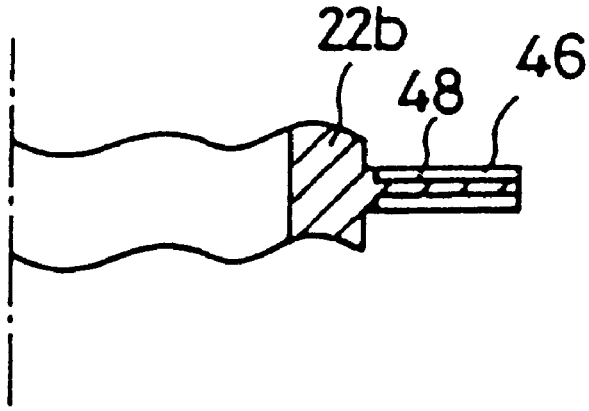
FIG. 2B is a cross-sectional view of a rotor blade of the thread groove pumping assembly in the turbo-molecular pump shown in FIG. 1.

FIGS. 1, 2A and 2B show a turbo-molecular pump according to a first embodiment of the present invention. As shown in FIG. 1, the turbo-molecular pump according to the first embodiment has a cylindrical pump casing 10 housing a rotor R and a stator S therein, and a turbine blade pumping assembly L1 and a thread groove pumping assembly L2 provided between the rotor R and the stator S. The pump casing 10 has flanges 12*a*, 12*b* on respective upper and lower ends thereof. An apparatus or a pipe to be evacuated is connected to the upper flange 12*a* which defines an inlet port therein. In this embodiment, the thread groove pumping assembly L2 comprises a spiral thread groove pumping assembly.

The stator S comprises a base 14 joined to the lower flange 12*b* in covering relationship to a lower opening of the pump casing 10, a cylindrical sleeve 16 extending vertically from the central portion of the base 14, and stationary components of the turbine blade pumping assembly L1 and the thread groove pumping assembly L2. The base 14 has an outlet port 18 defined therein for discharging the gas delivered from the apparatus or the pipe to be evacuated.

The rotor R comprises a main shaft 20 inserted coaxially in the sleeve 16, and a rotor body 22 mounted on the main shaft 20 and disposed around the sleeve 16. The rotor body 22 comprises a component 22*a* of the turbine blade pumping assembly L1 and a component 22*b* of the thread groove pumping assembly L2. The components 22*a* and 22*b* are composed of discrete members. The component 22*b* is positioned downstream of the component 22*a*, but is axially joined to the component 22*a*.

Between an outer circumferential surface of the main shaft 20 and an inner circumferential surface of the sleeve 16, there are provided a motor 24 for rotating the rotor R, an upper radial magnetic bearing 26, a lower radial magnetic bearing 28, and an axial magnetic bearing 30 which support the rotor R out of contact with the stator S. The axial bearing 30 has a target disk 30a mounted on the lower end of the main shaft 20, and upper and lower electromagnets 30*b* provided on the stator side. By this magnetic bearing system, the rotor R can be rotated at a high speed by the motor 24 under 5-axis active control. The sleeve 16 supports touch-down bearings 32*a*, 32*b* on its upper and lower portions for holding the main shaft 20 in a contact manner.

The rotor R also includes a plurality of axially spaced disk-shaped rotor blades 34 integrally projecting radially outwardly from an outer circumferential surface of the component 22*a* of the rotor body 22. The stator S includes a plurality of axially spaced stator blades 36 integrally projecting radially inwardly from an inner circumferential surface of the pump casing 10. The rotor blades 34 and the stator blades 36 are alternately disposed in an axial direction. The stator blades 36 have radially outer edges vertically held in position by stator blade spacers 38. The rotor blades 34 have inclined blades (not shown) radially extending between an inner circumferential hub and an outer circumferential frame for imparting an axial impact to gas molecules to discharge the gas upon rotation of the rotor R at a high speed.

The thread groove pumping assembly L2 is disposed downstream, i.e., downwardly, of the turbine blade pumping assembly L1. The rotor R further includes a plurality of axially spaced disk-shaped rotor blades 40 integrally projecting radially outwardly from an outer circumferential surface of the component 22*b* of the rotor body 22. The stator S further includes a plurality of axially spaced stator blades 42 integrally projecting radially inwardly from an inner circumferential surface of the pump casing 10. The rotor blades 40 and the stator blades 42 are alternately disposed in an axial direction. The stator blades 42 have radially outer edges vertically held in position by stator blade spacers 44.

As shown in FIGS. 2A and 2B, each of the rotor blades 40 has spiral ridges 46 on its upper and lower surfaces, with spiral thread grooves 48 defined between the spiral ridges 46. The spiral thread grooves 48 on the upper surface of each of the rotor blades 40 are shaped such that gas molecules flow radially outwardly in the direction indicated by the solid-line arrow B in FIG. 2A when the rotor blades 40 rotate in the direction indicated by the arrow A. The spiral thread grooves 48 on the lower surface of each of the rotor blades 40 are shaped such that gas molecules flow radially inwardly in the direction indicated by the broken-line arrow C in FIG. 2A when the rotor blades 40 rotate in the direction indicated by the arrow A.

As described above, the rotor body 22 has such a structure that the component 22*a* of the turbine blade pumping assembly L1 and the component 22*b* of the thread groove pumping assembly L2 which are separately formed are joined to each other. The component 22*a* includes the rotor blades 34 and a boss 23 fitted over the main shaft 20, the rotor blades 34 and the boss 23 being integrally formed by machining. The component 22*b* includes the rotor blades 40 with the spiral thread grooves, and are formed by machining or the like. The components 22*a*, 22*b* have annular steps 25*a*, 25*b* on their mating ends which are held in interfitting engagement with each other. The components 22*a*, 22*b* may be joined to each other by shrink fitting or bolts.

The thread groove pumping assembly L2 provides a long zigzag discharge passage extending downwardly in a relatively short axial range between the stator blades 42 and the rotor blades 40. The rotor R of the above structure can easily be manufactured under less strict machining limitations, but is of a shape suitable for a high evacuation and compression capability. Therefore, the turbo-molecular pump can evacuate gas at a high rate, and has high compression capability.

If the rotor body 22 which has the rotor blades 34 of the turbine blade pumping assembly L1 and the rotor blades 40 of the thread groove pumping assembly L2 are to be machined as an integral body, then a highly complex and costly machining process need to be performed over a long period of time because the spiral thread grooves 48 of the rotor blades 40 are complex in shape. It may even be impossible to carry out such a machining process depending on the shape of the spiral thread grooves 48. According to the illustrated embodiment, however, since the component 22a of the turbine blade pumping assembly L1 and the component 22*b* of the thread groove pumping assembly L2 are manufactured separately from each other, the rotor body 22 can be machined much more easily at a highly reduced cost.

In the first embodiment, the component 22*b* of the thread groove pumping assembly L2 comprises a single component. However, the component 22*b* of the thread groove pumping assembly L2 may comprise a vertical stack of joined hollow disk-shaped members divided into a plurality of stages. Those hollow disk-shaped members may be joined together by shrink fitting or bolts. It is preferable to construct the component 22*b* by a plurality of members in case that the spiral thread grooves are complex in shape and are impossible to be machined practically.

In the illustrated embodiment, the rotor blades 40 has the spiral thread grooves 48 in the thread groove pumping assembly L2. However, the stator blades 42 may have the spiral thread grooves 48. Such a modification is also applicable to other embodiments of the present invention which will be described below.

Figure 3:
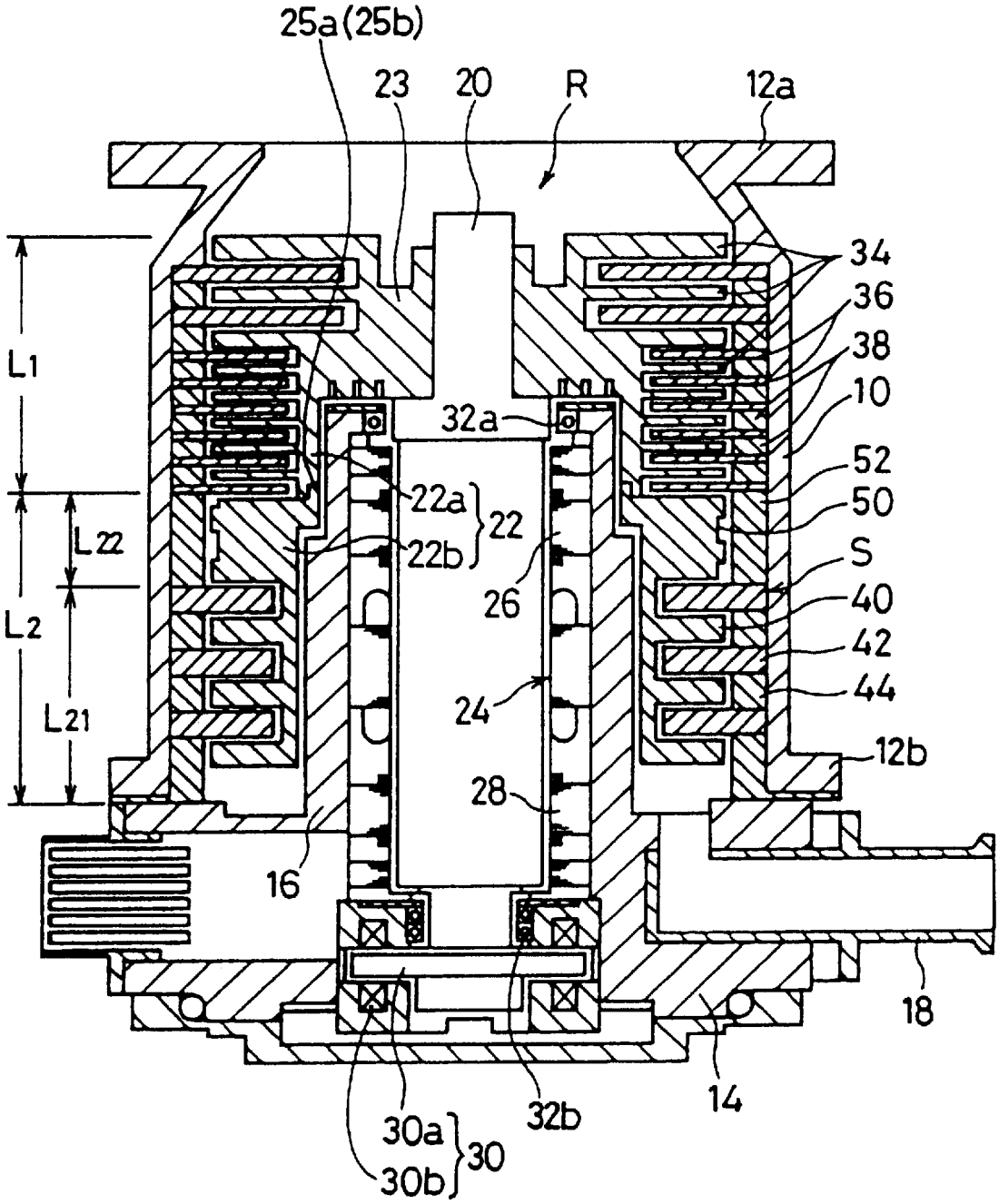
FIG. 3 is an axial cross-sectional view of a turbo-molecular pump according to a second embodiment of the present invention.

FIG. 3 shows a turbo-molecular pump according to a second embodiment of the present invention. As shown in FIG. 3, the turbo-molecular pump according to the second embodiment includes a rotor body 22 which has a thread groove pumping assembly L2 comprising a spiral thread groove pumping assembly L21 and a cylindrical thread groove pumping assembly L22 disposed upstream of the spiral thread groove pumping assembly L21. The cylindrical thread groove pumping assembly L22 has cylindrical thread grooves 50 defined in an outer circumferential surface of a component 22*b* of the thread groove pumping assembly L2. The cylindrical thread groove pumping assembly L22 also has a spacer 52 in the stator S which is positioned radially outwardly of the cylindrical thread grooves 50. When the rotor R rotates at a high speed, gas molecules are dragged and discharged along the cylindrical thread grooves 50 of the cylindrical thread groove pumping assembly L22.

Figure 4:
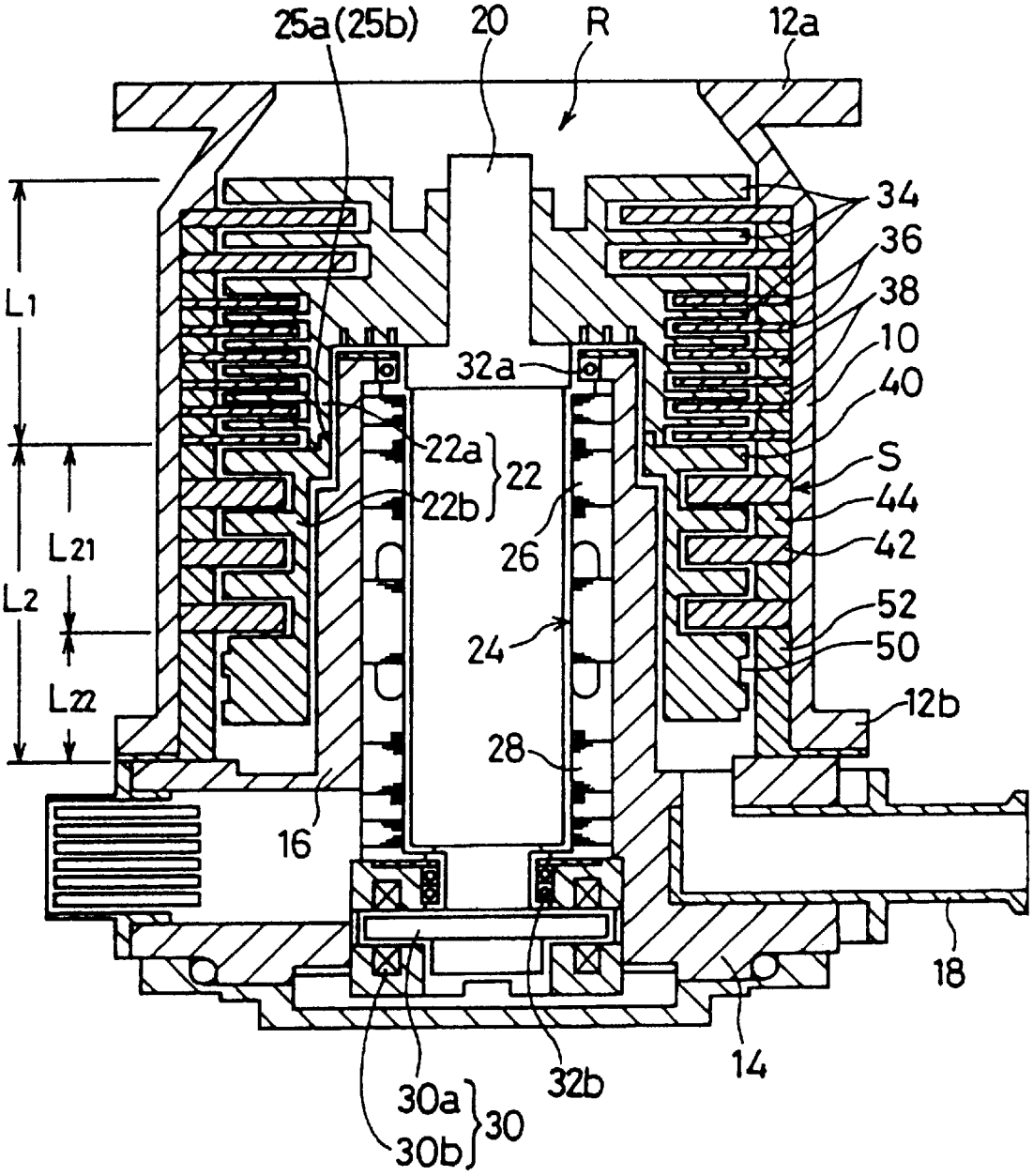
FIG. 4 is an axial cross-sectional view of a turbo-molecular pump according to a third embodiment of the present invention.

FIG. 4 shows a turbo-molecular pump according to a third embodiment of the present invention. As shown in FIG. 4, the turbo-molecular pump according to the third embodiment includes a rotor body 22 which has a thread groove pumping assembly L2 comprising a spiral thread groove pumping assembly L21 and a cylindrical thread groove pumping assembly L22 disposed downstream of the spiral thread groove pumping assembly L21.

Figure 5:
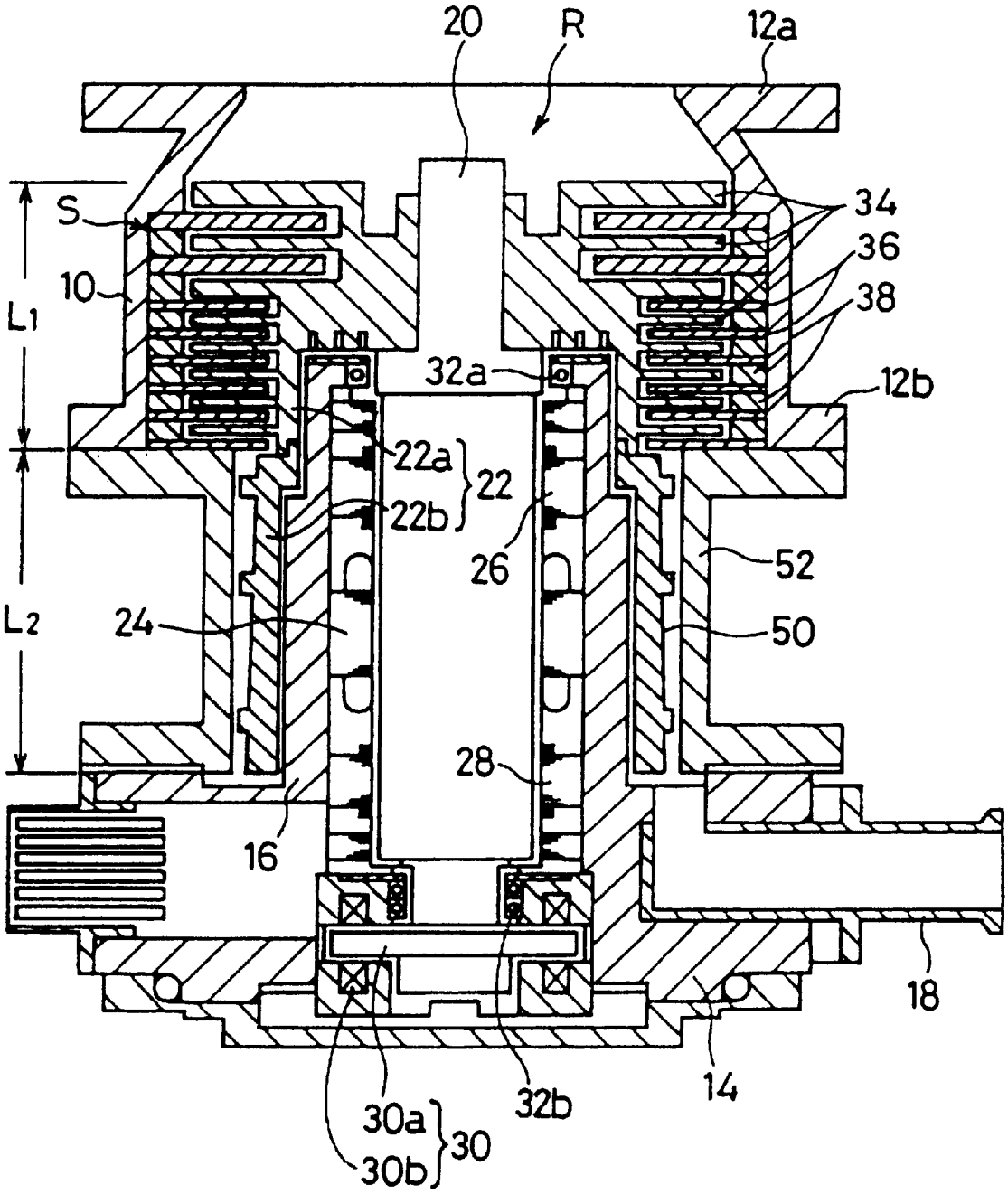
FIG. 5 is an axial cross-sectional view of a pump according to a fourth embodiment of the present invention.

FIG. 5 shows a turbo-molecular pump according to a fourth embodiment of the present invention. As shown in FIG. 5, the turbo-molecular pump according to the fourth embodiment includes a rotor body 22 which has a thread groove pumping assembly L2 comprising a cylindrical thread groove pumping assembly only. Specifically, the thread groove pumping assembly L2 has a substantially cylindrical component 22*b* having cylindrical thread grooves 50 defined in an outer circumferential surface thereof. The thread groove pumping assembly L2 also has a spacer 52 in the stator S which is positioned radially outwardly of the cylindrical thread grooves 50. When the rotor R rotates at a high speed, gas molecules are dragged and discharged along the cylindrical thread grooves 50 of the thread groove pumping assembly L2.

Figure 6:
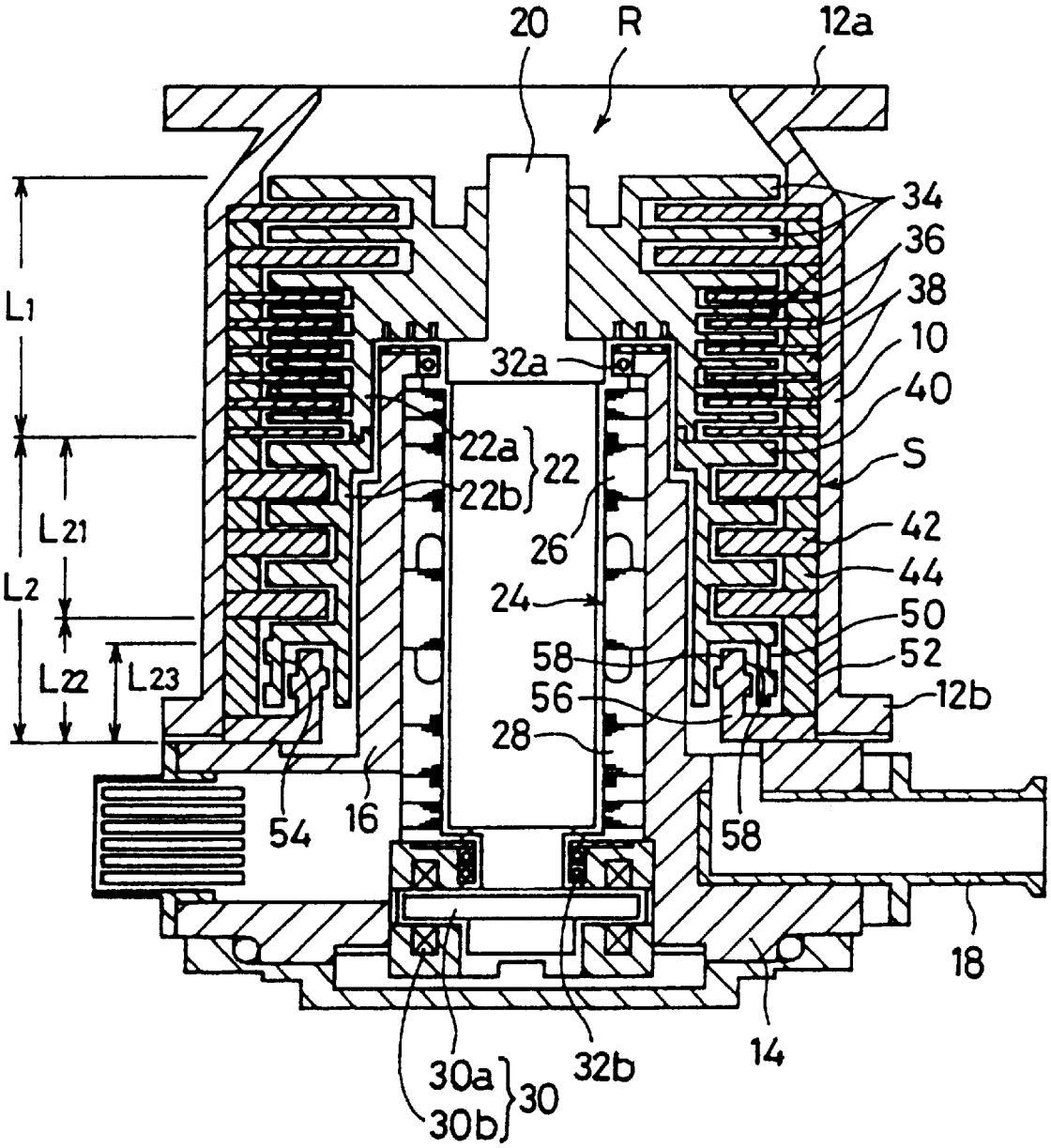
FIG. 6 is an axial cross-sectional view of a turbo-molecular pump according to a fifth embodiment of the present invention.

FIG. 6 shows a turbo-molecular pump according to a fifth embodiment of the present invention. As shown in FIG. 6, the turbo-molecular pump according to the fifth embodiment has a thread groove pumping assembly L2 comprising a spiral thread groove pumping assembly L21, a cylindrical thread groove pumping assembly L22 positioned downstream of the spiral thread groove pumping assembly L21, and a dual cylindrical thread groove pumping assembly L23 positioned within the cylindrical thread groove pumping assembly L22. Specifically, the thread groove pumping assembly L2 has a component 22*b* having a recess 54 formed in the lower end thereof, and the dual cylindrical thread groove pumping assembly L23 has a sleeve 56 disposed in the recess 54. The sleeve 56 has cylindrical thread grooves 58 defined in inner and outer circumferential surfaces thereof.

In operation, the cylindrical thread grooves 58 formed in the outer circumferential surface of the sleeve 56 discharge gas molecules downwardly due to a dragging action produced by rotation of the rotor R, and the cylindrical thread grooves 58 formed in the inner circumferential surface of the sleeve 56 discharge gas molecules upwardly due to a dragging action produced by rotation of the rotor R. Therefore, a discharge passage extending from the cylindrical thread groove pumping assembly L22 through the dual cylindrical thread groove pumping assembly L23 to the outlet port 18 is formed. Since the dual cylindrical thread groove pumping assembly L23 is disposed in the cylindrical thread groove pumping assembly L22, the turbo-molecular pump shown in FIG. 6 has a relatively small axial length, and has a higher evacuation and compression capability.

Figure 7:
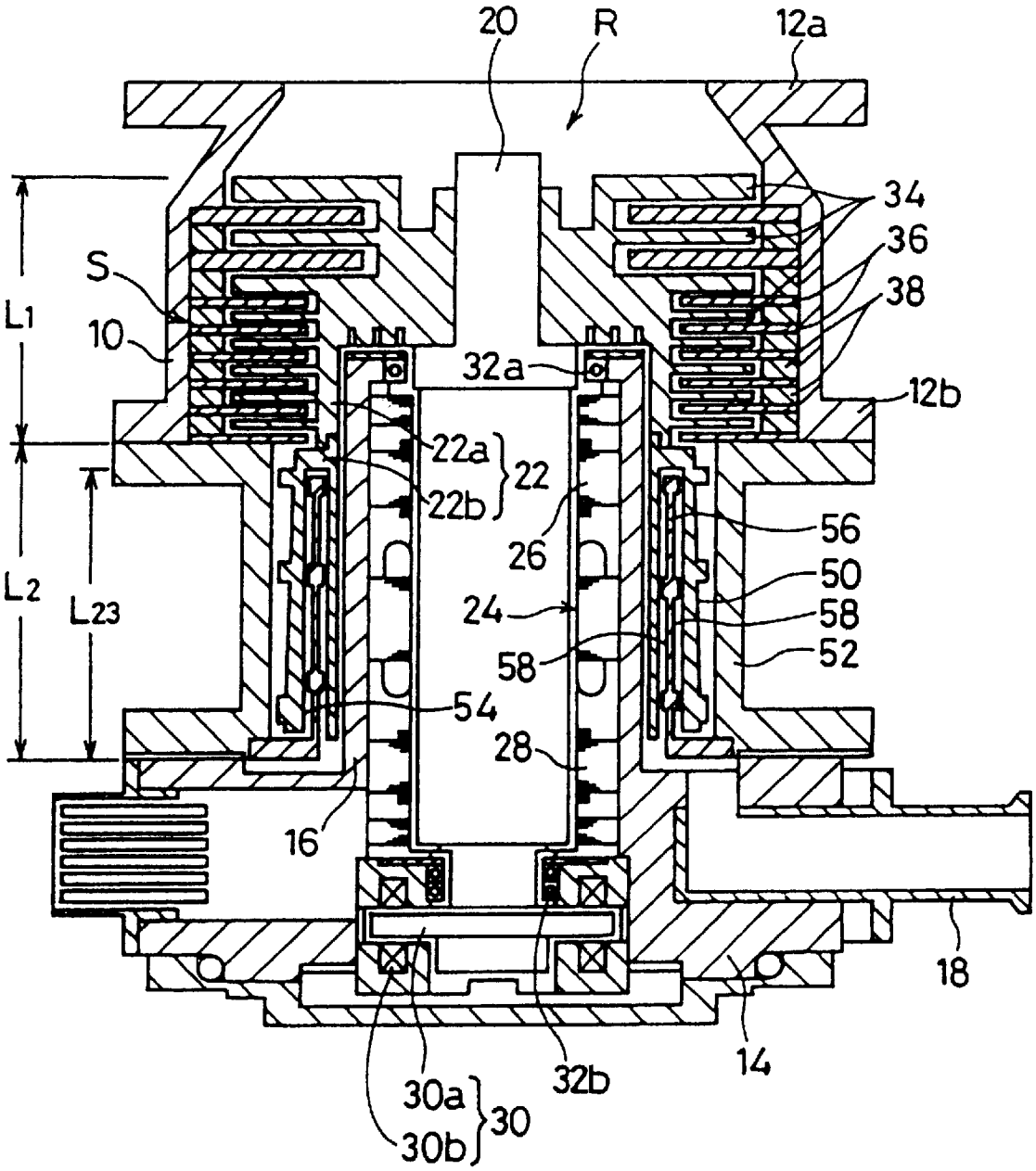
FIG. 7 is an axial cross-sectional view of a pump according to a sixth embodiment of the present invention.

FIG. 7 shows a turbo-molecular pump according to a sixth embodiment of the present invention. As shown in FIG. 7, the turbo-molecular pump according to the sixth embodiment has a thread groove pumping assembly L2 comprising a cylindrical thread groove pumping assembly similar to the cylindrical thread groove pumping assembly shown in FIG. 5, and a dual cylindrical thread groove pumping assembly L23 positioned within the cylindrical thread groove pumping assembly L22. Specifically, the thread groove pumping assembly L2 of the rotor body 22 has a component 22*b* with a recess 54 defined therein and extending in substantially the full axial length thereof. The dual cylindrical thread groove pumping assembly L23 has a sleeve 56 disposed in the recess 54. The sleeve 56 has cylindrical thread grooves 58 defined in inner and outer circumferential surfaces thereof.

Figure 8:
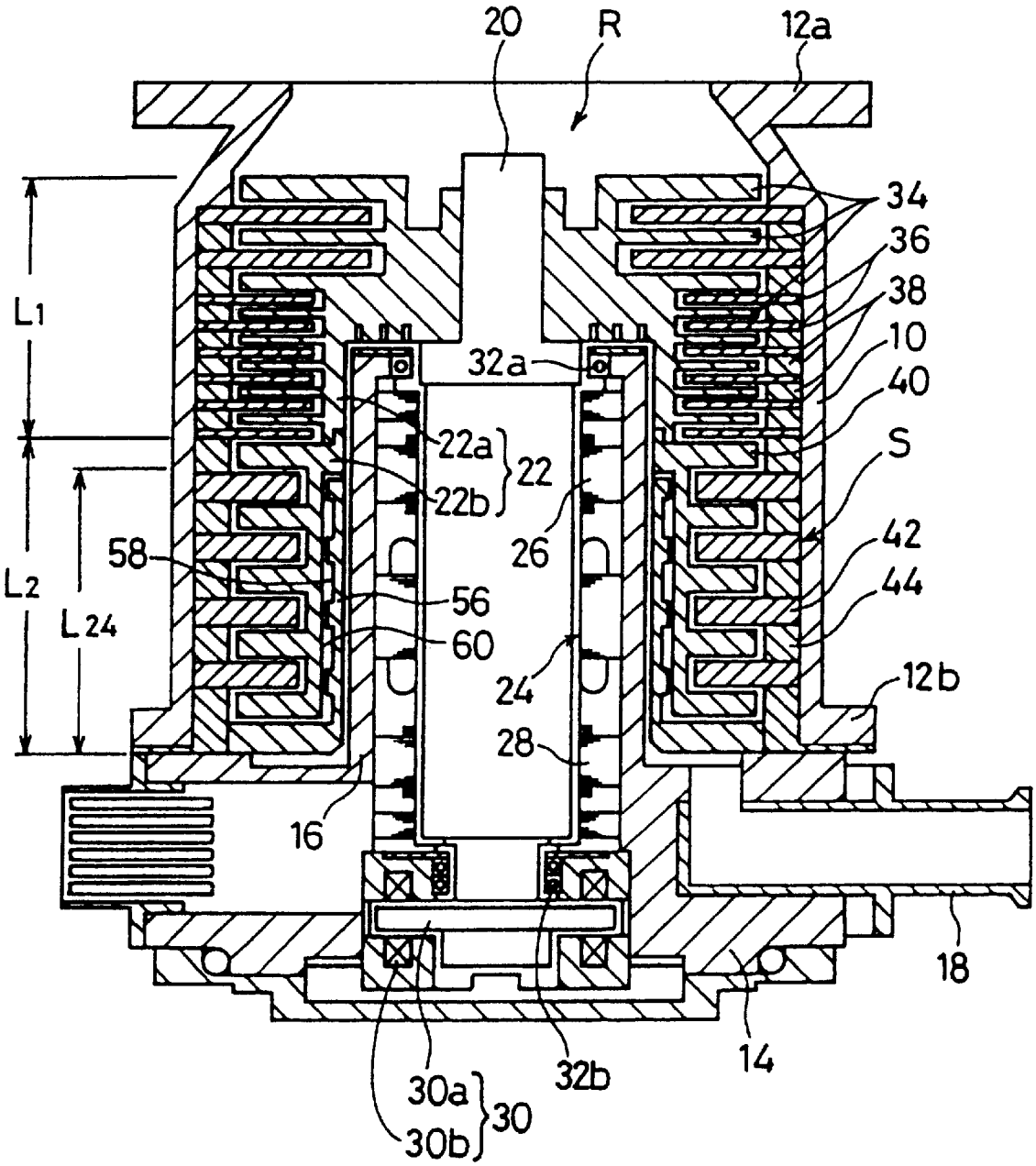
FIG. 8 is an axial cross-sectional view of a pump according to a seventh embodiment of the present invention.

FIG. 8 shows a turbo-molecular pump according to a seventh embodiment of the present invention. As shown in FIG. 8, the turbo-molecular pump according to the seventh embodiment has a thread groove pumping assembly L2 comprising, in addition to the spiral thread groove pumping assembly shown in FIGS. 1, 2A and 2B, an inner cylindrical thread groove pumping assembly L24 disposed within the thread groove pumping assembly L2. Specifically, the component 22*b* of the thread groove pumping assembly L2 of the rotor body 22 has a recess 60 defined therein around the cylindrical sleeve 16 to provide a space between the inner circumferential surface of the component 22*b* and the outer inner circumferential surface of the cylindrical sleeve 16. A sleeve 56 having cylindrical thread grooves 58 formed in an outer circumferential surface thereof is inserted in the space.

Therefore, in this embodiment, a discharge passage extending from the lowermost end of the spiral thread groove pumping assembly upwardly between the rotor body 22 and the sleeve 56 and then downwardly between the sleeve 56 and the cylindrical sleeve 16 to the outlet port 18 is formed.

Figure 9:
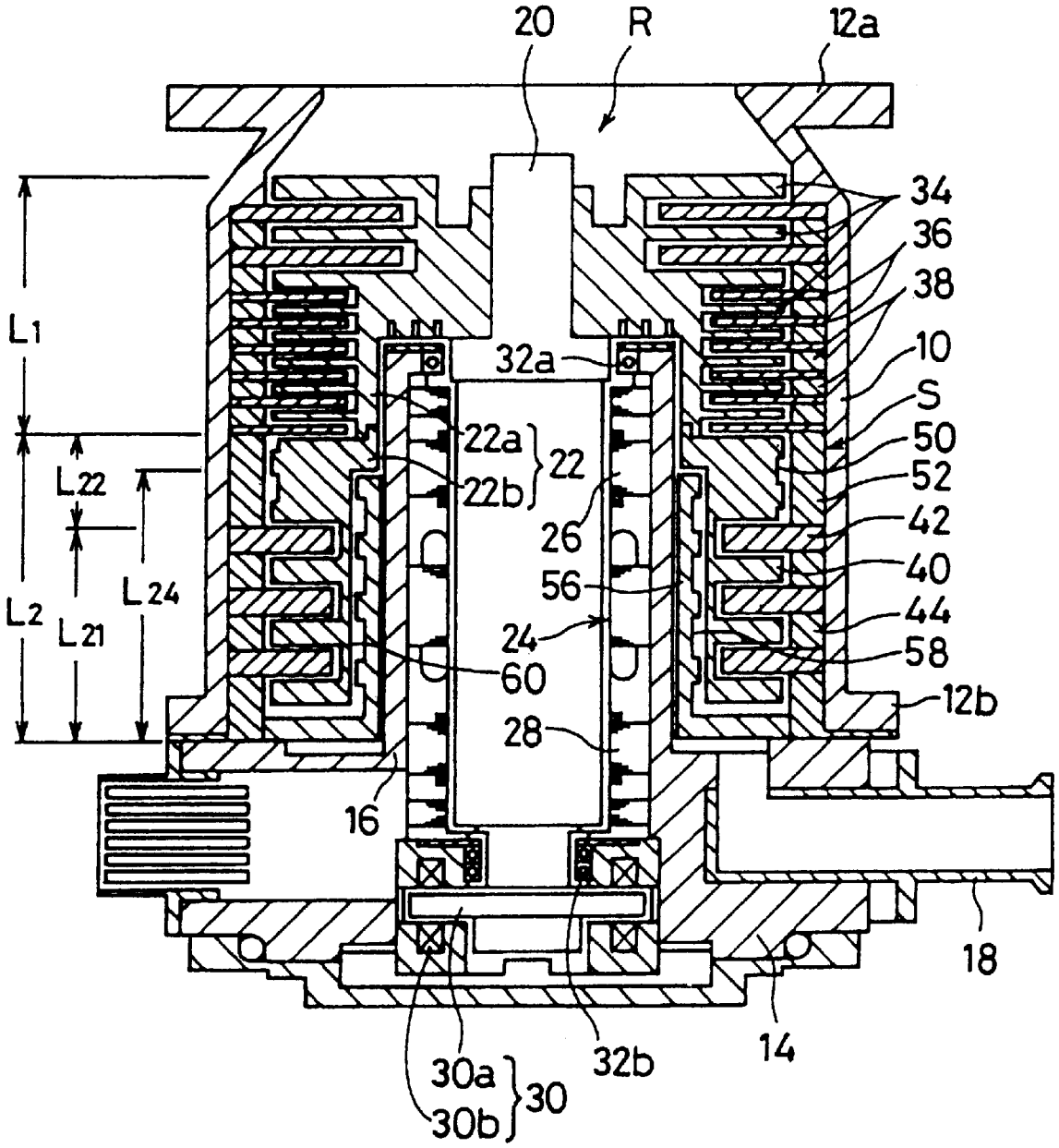
FIG. 9 is an axial cross-sectional view of a turbo-molecular pump according to an eighth embodiment of the present invention.

FIG. 9 shows a turbo-molecular pump according to an eighth embodiment of the present invention. As shown in FIG. 9, the turbo-molecular pump according to the eighth embodiment has a thread groove pumping assembly L2 comprising, in addition to the spiral thread groove pumping assembly L21 and the cylindrical thread groove pumping assembly L22 disposed upstream of the spiral thread groove pumping assembly L21 shown in FIG. 4, an inner cylindrical thread groove pumping assembly L24 disposed within the spiral thread groove pumping assembly L21 and the cylindrical thread groove pumping assembly L22.

Figure 10:
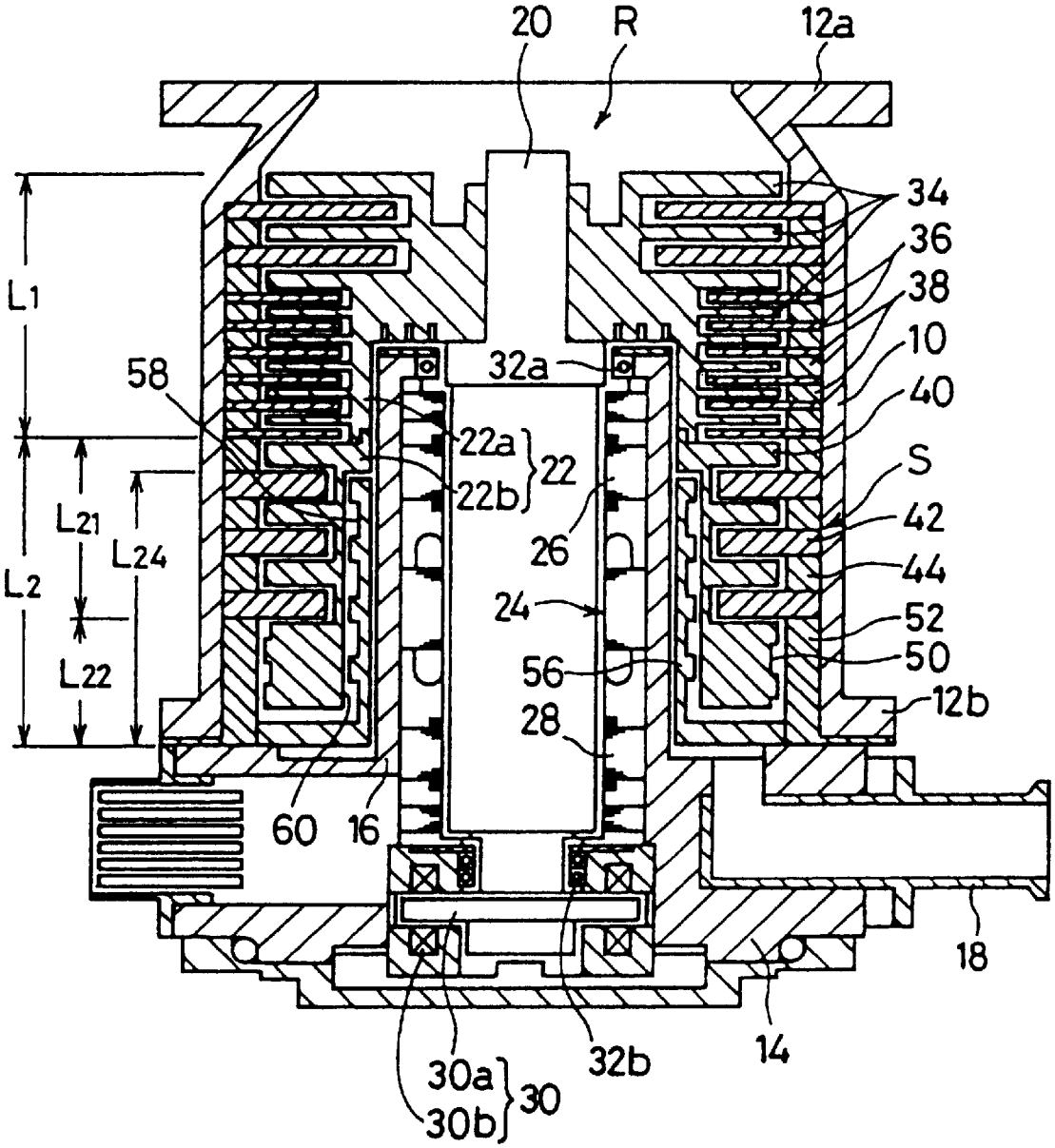
FIG. 10 is an axial cross-sectional view of a turbo-molecular pump according to a ninth embodiment of the present invention.

FIG. 10 shows a turbo-molecular pump according to a ninth embodiment of the present invention. As shown in FIG. 10, the turbo-molecular pump according to the ninth embodiment has a thread groove pumping assembly L2 comprising, in addition to the spiral thread groove pumping assembly L21 and the cylindrical thread groove pumping assembly L22 disposed downstream of the spiral thread groove pumping assembly L21 shown in FIG. 3, an inner cylindrical thread groove pumping assembly L24 disposed within the spiral thread groove pumping assembly L21 and the cylindrical thread groove pumping assembly L22.

Figure 11:
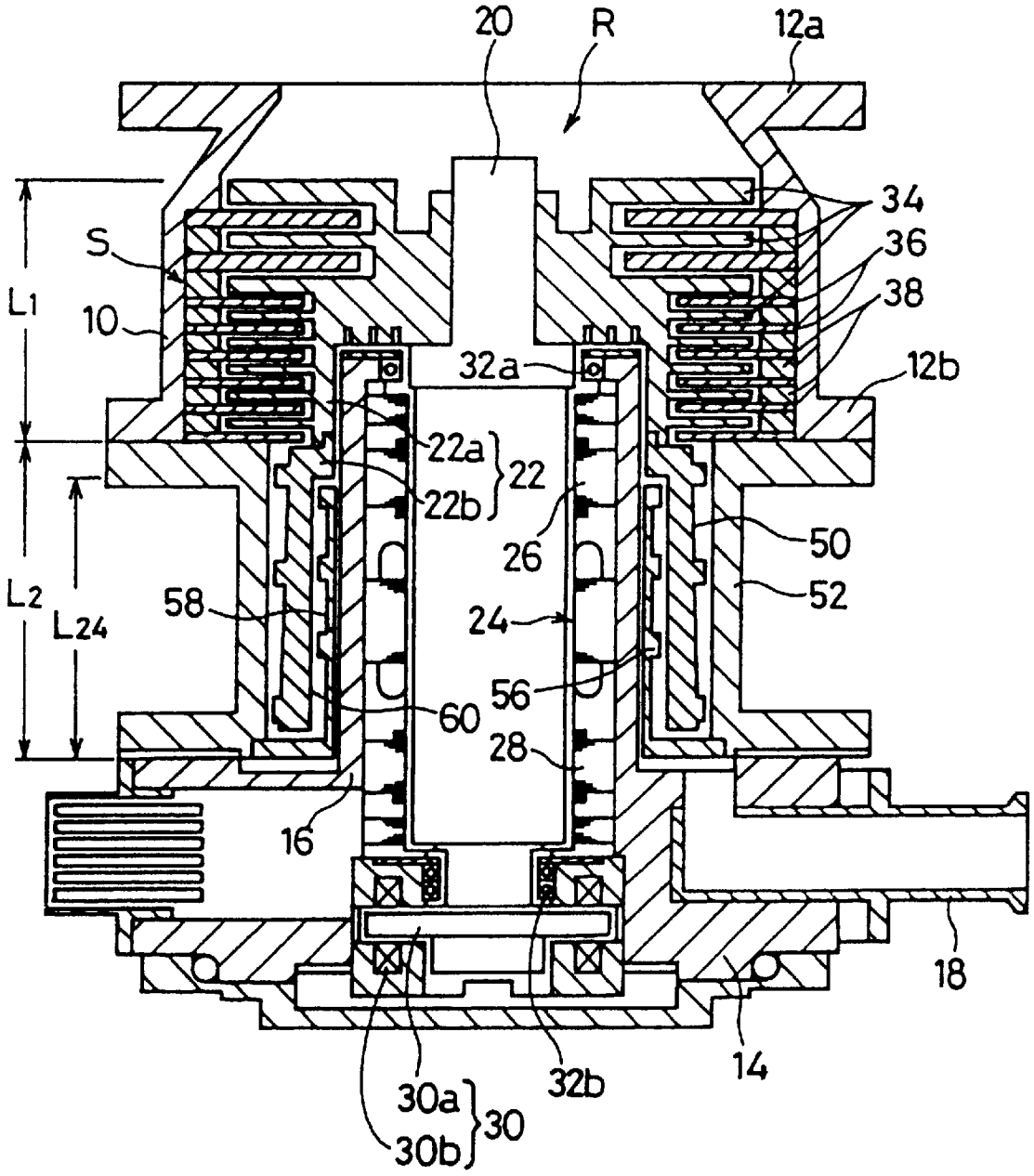
FIG. 11 is an axial cross-sectional view of a turbo-molecular pump according to a tenth embodiment of the present invention.

FIG. 11 shows a turbo-molecular pump according to a tenth embodiment of the present invention. As shown in FIG. 11, the turbo-molecular pump according to the tenth embodiment has a thread groove pumping assembly L2 comprising, in addition to the cylindrical thread groove pumping assembly shown in FIG. 5, an inner cylindrical thread groove pumping assembly L24 disposed within the cylindrical thread groove pumping assembly L2.

In the embodiments shown in FIGS. 6 through 11, the thread groove pumping assembly provides dual passages that are radially superposed for discharging gas molecules. However, the thread groove pumping assembly may provide three or more radially superposed passages for discharging gas molecules.

In the above embodiments, the stator blades and/or the rotor blades may be made of aluminum or its alloys. However, the stator blades and/or the rotor blades may be made of an alloy of titanium or ceramics. With the stator blades and/or the rotor blades being made of an alloy of titanium or ceramics, the turbo-molecular pump has a high mechanical strength, a high corrosion resistance, and a high heat resistance. Alloys of titanium have a high mechanical strength at high temperatures, can reduce the effect of creeping on the service life of the turbo-molecular pump, and are highly resistant to corrosion. Since ceramics has a very small coefficient of linear expansion and is thermally deformable to a smaller extent than the aluminum alloys, the rotor blades made of ceramics can rotate highly stably at high temperatures. Inasmuch as titanium and ceramics have a high specific strength than aluminum, the rotor made of titanium or ceramics can be increased in diameter for a greater evacuating capability.

The rotor blades, the stator blades, and the components with the spiral thread grooves and the multiple cylindrical thread grooves defined therein may be constructed as members of different materials, e.g., aluminum, titanium, and ceramics, that are individually formed and subsequently joined together. For example, the rotor blades may be made of aluminum, and the components with the spiral thread grooves may be made of titanium. Of course, the rotor blades, the stator blades, and the components with the spiral and cylindrical thread grooves defined therein may be composed of one material.

According to the present invention, as described above, the rotor can easily be manufactured in a shape suitable for a high evacuation and compression capability. Therefore, the turbo-molecular pump can evacuate gas in the desired apparatus or pipe at a high rate and has high compression capability. Consequently, the turbo-molecular pump can effectively be incorporated in a facility where the available space is expensive, such as a clean room in which a semiconductor fabrication apparatus is accommodated therein, for reducing the costs of equipment and operation.

Although certain preferred embodiments of the present invention have been shown and described in detail, it should be understood that various changes and modifications may be made therein without departing from the scope of the appended claims.

What is claimed is:

1. A turbo-molecular pump comprising:

a casing;

a stator fixedly mounted in said casing;

a rotor supported in said casing and being rotatable at a high speed; and a turbine blade pumping assembly and a thread groove pumping assembly which are disposed between said stator and said rotor;

said rotor being formed by joining at least two components which are separable from each other at a predetermined position; and said two components including annular steps on mating ends thereof.

2. A turbo-molecular pump according to claim 1, wherein one of said at least two components constituting said thread groove pumping assembly is disposed downstream of and joined to the other of said at least two components constituting said turbine blade pumping assembly.

3. A turbo-molecular pump according to claim 1, wherein said thread groove pumping assembly comprises at least one of a spiral thread groove pumping assembly for discharging gas molecules radially and a cylindrical thread groove pumping assembly for discharging gas molecules axially.

4. A turbo-molecular pump according to claim 1, wherein said rotor has a coaxial multiple-passage structure.

5. A pump according to claim 1, wherein said at least two components are made of different materials.

6. A turbo-molecular pump according to claim 1, wherein the two components are joined by a shrink fit.

7. A turbo-molecular pump according to claim 1, wherein the two components are joined by a bolts.

8. A turbo-molecular pump comprising:

a casing;

a stator fixedly mounted in said casing;

a rotor supported in said casing and being rotatable at a high speed; and a turbine blade pumping assembly and a thread groove pumping assembly which are disposed between said stator and said rotor;

said rotor being formed by joining at least two components which are separable from each other at a predetermined position;

wherein said rotor includes multiple coaxial passages that are radially superposed.

9. A turbo-molecular pump according to claim 8, wherein the coaxial passages comprise cylindrical thread grooves.

* * * * *

UNITED STATES PATENT AND TRADEMARK OFFICE

CERTIFICATE OF CORRECTION

PATENT NO. : 6,343,910 B1 
DATED : February 5, 2002
INVENTOR(S) : Kawasaki et al.

It is certified that error appears in the above-identified patent and that said Letters Patent is hereby corrected as shown below:

Column 8,
Lines 52 thru 59, change
"a turbine blade pumping assembly and a thread groove pumping assembly which are disposed between said stator and said rotor;
said rotor being formed by joining at least two components which are separable from each other at a predetermined position; and
said two components include annular steps on mating ends thereof"
to be
-- wherein the stator and rotor form a turbine blade pumping assembly and a thread groove pumping assembly;
wherein a first component of said rotor forms a portion of said turbine blade pumping assembly,
wherein a second component of said rotor forms a portion of said thread groove pumping assembly;
said first and second components including annular steps on mating ends thereof, said annular steps interfitting with each other. --

Signed and Sealed this

Eleventh Day of June, 2002

*Attest:*

*Attesting Officer*

JAMES E. ROGAN
*Director of the United States Patent and Trademark Office*